US009084527B2

(12) United States Patent
Haft et al.

(10) Patent No.: US 9,084,527 B2
(45) Date of Patent: Jul. 21, 2015

(54) DOOR FOR AN APPLIANCE

(71) Applicant: Wolf Appliance, Inc., Fitchburg, WI (US)

(72) Inventors: Thomas Haft, Madison, WI (US); Colin R. Clerkin, Waunakee, WI (US); Gerry Lippincott, Milton, WI (US); Brian Wylie, Stoughton, WI (US); Dan Yokes, Verona, WI (US); Randy Campbell, Madison, WI (US); Curtis Leroy Cruver, IV, Elmhurst, IL (US)

(73) Assignee: Wolf Appliances, Inc., Fitchburg, WI (US)

( * ) Notice: Subject to any disclaimer, the term of this patent is extended or adjusted under 35 U.S.C. 154(b) by 186 days.

(21) Appl. No.: 13/925,205

(22) Filed: Jun. 24, 2013

(65) Prior Publication Data

US 2014/0373455 A1 Dec. 25, 2014

(51) Int. Cl.
*F23M 7/00* (2006.01)
*A47L 15/42* (2006.01)

(52) U.S. Cl.
CPC ..... *A47L 15/4261* (2013.01)

(58) Field of Classification Search
CPC ..... A47L 15/4261
USPC ..... 49/501; 312/204, 228, 327; 62/449; 126/190, 194, 198
See application file for complete search history.

(56) References Cited

U.S. PATENT DOCUMENTS

| | | | | |
|---|---|---|---|---|
| D232,187 | S | 7/1974 | McCollom, Jr. | |
| 5,133,487 | A | 7/1992 | Russi | |
| 5,261,432 | A | 11/1993 | Sandrin | |
| D352,578 | S | 11/1994 | Mooney et al. | |
| 5,645,331 | A * | 7/1997 | Eddy et al. | 312/205 |
| 5,735,261 | A * | 4/1998 | Kieslinger | 126/190 |
| 6,622,896 | B2 | 9/2003 | Hegeman et al. | |
| D488,895 | S | 4/2004 | Cheo et al. | |
| 6,722,083 | B2 * | 4/2004 | Herrmann et al. | 49/501 |
| 6,736,470 | B2 | 5/2004 | Manke et al. | |
| D512,544 | S | 12/2005 | Jeong et al. | |
| D515,255 | S | 2/2006 | Jeong | |
| 7,014,281 | B2 | 3/2006 | Wuestefeld et al. | |
| D540,497 | S | 4/2007 | Song | |
| D543,321 | S | 5/2007 | Jeon et al. | |
| D544,657 | S | 6/2007 | Jung et al. | |
| 7,231,928 | B2 | 6/2007 | Dingler et al. | |
| 7,275,552 | B2 | 10/2007 | DeWeerd et al. | |
| D571,062 | S | 6/2008 | Suh et al. | |

(Continued)

FOREIGN PATENT DOCUMENTS

WO WO2009/141129 11/2009

*Primary Examiner* — Jerry Redman

(74) *Attorney, Agent, or Firm* — Bell & Manning, LLC

(57) ABSTRACT

A door includes a first door assembly, a second door assembly mounted to the first door assembly, a left hinge, and a right hinge. The first door assembly includes a first panel, a first brace, and a plurality of tabs that extend from the first brace. The second door assembly includes a second panel, a second brace, and a plurality of slots formed in the second brace. The first brace is mounted between a left side flange of the first panel assembly and a right side flange of the first panel assembly. The second brace is mounted between a left side flange of the second panel assembly and a right side flange of the second panel assembly. The plurality of tabs are configured to align with and to slide down into respective ones of the plurality of slots to mount the first door assembly to the second door assembly.

20 Claims, 18 Drawing Sheets

(56) References Cited

U.S. PATENT DOCUMENTS

| | | | | |
|---|---|---|---|---|
| D580,603 | S | 11/2008 | Busalt et al. | |
| 7,478,502 | B2 | 1/2009 | Bienick et al. | |
| 7,578,566 | B2 | 8/2009 | DiEnno et al. | |
| 7,665,810 | B2 | 2/2010 | Crompton et al. | |
| D622,915 | S | 8/2010 | Crookshanks et al. | |
| 7,850,787 | B2 | 12/2010 | Buser | |
| 8,020,949 | B2 * | 9/2011 | Davis et al. | 312/204 |
| D649,833 | S | 12/2011 | Browne et al. | |
| D675,792 | S | 2/2013 | Eng et al. | |
| 8,382,219 | B2 | 2/2013 | Hottmann et al. | |
| 8,460,479 | B2 | 6/2013 | Haeberle et al. | |
| 2005/0000551 | A1 | 1/2005 | McIntyre et al. | |
| 2009/0288692 | A1 | 11/2009 | Haeberle et al. | |
| 2010/0141103 | A1 | 6/2010 | Olesen et al. | |
| 2010/0170290 | A1 | 7/2010 | Arzoz Barandalla et al. | |
| 2010/0283359 | A1 * | 11/2010 | Hottmann et al. | 312/204 |
| 2011/0031856 | A1 | 2/2011 | Haltmayer et al. | |
| 2011/0061308 | A1 * | 3/2011 | Badger | 49/501 |
| 2012/0090643 | A1 | 4/2012 | Bertsch et al. | |
| 2013/0049559 | A1 | 2/2013 | Koitzsch et al. | |
| 2013/0087173 | A1 | 4/2013 | Welch | |

* cited by examiner

DOOR FOR AN APPLIANCE

BACKGROUND

Various appliances have doors that are hinged near a bottom edge, for example, to allow the withdrawal of shelves or baskets on which items are placed or to allow the insertion and removal of items from a cavity of the appliance. Example appliances include dishwashers, ovens, microwaves, washers, dryers, refrigerators, etc. Typically, a user pulls on a top of the door to open it.

The doors may include an outer panel assembly and an inner door assembly. The outer panel assembly is positioned over the exterior of the inner door assembly and is the primary component of the appliance that is visible to a consumer when the door is in a closed position relative to a body of the appliance. Thus, the outer panel assembly may be decorative and is generally aesthetically pleasing. The inner door assembly is visible to a consumer when the door is in an open position relative to the body of the appliance.

Current door construction designs utilize numerous (as many as 18) screws to attach the inner door assembly to the outer panel assembly. The screws are located on a visible surface of the inner door assembly. As such, the screws detract from the appearance of the door assembly and create a surface that becomes soiled through use of the appliance. The screws and the surrounding surface are difficult to clean due to the small crevices that are formed.

Servicing of the doors inner components, such as the controls for the appliance, also requires the removal of the screws, which makes provision of the service more difficult and time consuming and increases the likelihood that the retaining hole for the screw or the screw itself will become damaged. If one or more of the holes in the outer panel assembly is damaged, replacement of the entire outer panel assembly may be required.

SUMMARY

In an example embodiment, a door for an appliance is provided. The door may include, but is not limited to, a first door assembly, a second door assembly mounted to the first door assembly, a left hinge, and a right hinge. The first door assembly may include, but is not limited to, a first panel assembly, a first brace, and a plurality of tabs mounted to extend from the first brace. The first panel assembly may include, but is not limited to, a first panel, a left side flange mounted to extend from a left edge of the first panel, and a right side flange mounted to extend from a right edge of the first panel. The first brace is mounted between the left side flange of the first panel assembly and the right side flange of the first panel assembly. The second door assembly may include, but is not limited to, a second panel assembly, a second brace, and a plurality of slots formed in the second brace. The second panel assembly may include, but is not limited to, a second panel, a left side flange mounted to extend from a left edge of the second panel, and a right side flange mounted to extend from a right edge of the second panel. The second brace is mounted between the left side flange of the second panel assembly and the right side flange of the second panel assembly. The left hinge is mounted to either the left side flange of the first panel assembly or the left side flange of the second panel assembly. The right hinge is mounted to either the right side flange of the first panel assembly or the right side flange of the second panel assembly. The left hinge and the right hinge mount the door to a body of an appliance. The plurality of tabs are configured to align with and to slide down into respective ones of the plurality of slots to mount the first door assembly to the second door assembly.

In another example embodiment, an appliance is provided. The appliance may include, but is not limited to, a body and the door. The left hinge and the right hinge pivotally mount the door to the body.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
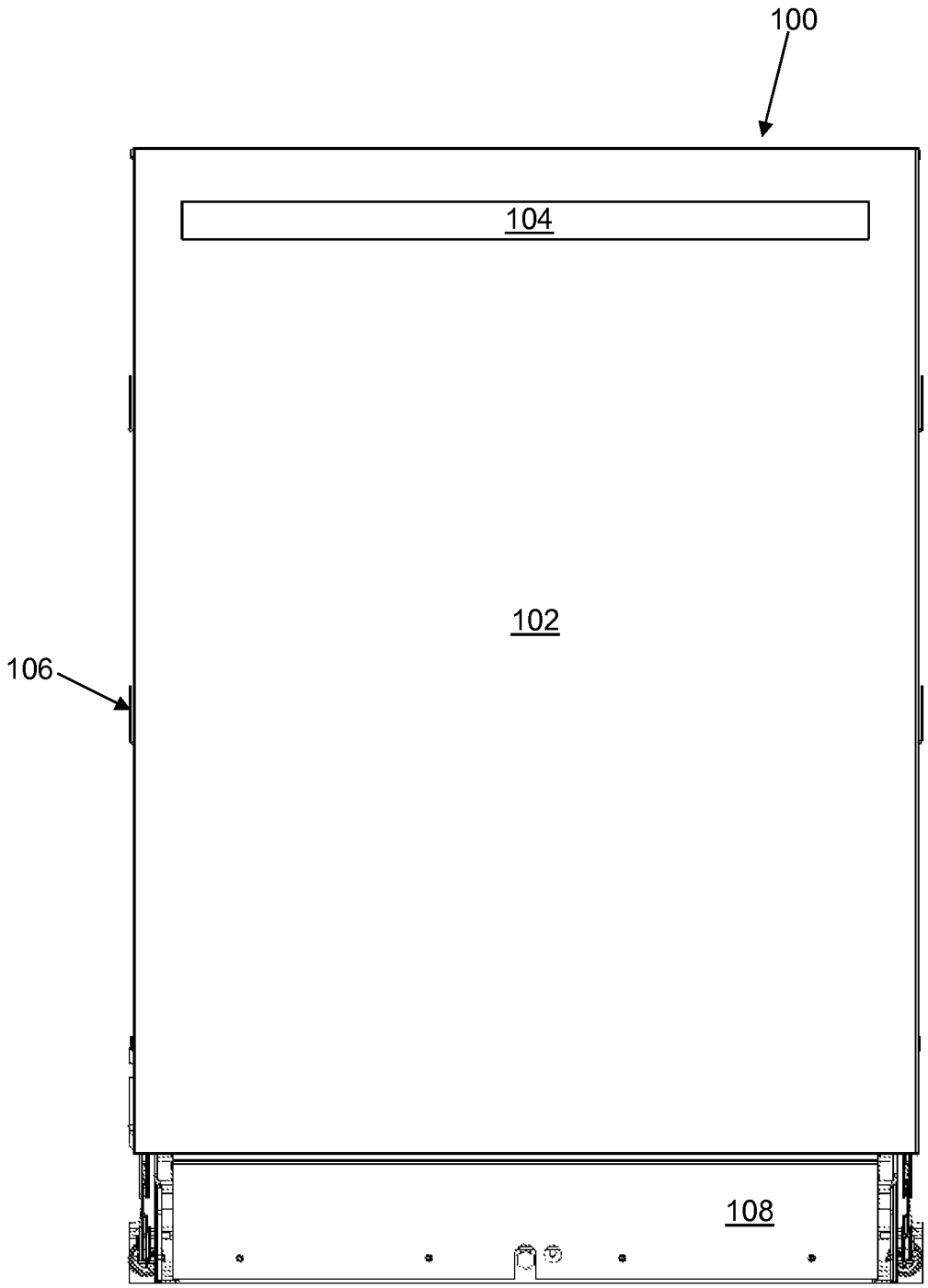
FIG. 1 depicts a front view of an appliance in accordance with an illustrative embodiment.

With reference to FIG. 1, an appliance 100 is shown in accordance with an illustrative embodiment. With reference to the illustrative embodiment of FIG. 1, appliance 100 is a dishwasher. In alternative embodiments, appliance 100 may include an oven, a microwave, a washer, a dryer, a refrigerator, or any other appliance that includes a door mounted on an appliance body using a plurality of bottom-mounted hinges.

With reference to FIG. 1, appliance 100 may include a door 102, a handle 104, and a body 106. Handle 104 may be mounted to door 102 near a top of door 102 to facilitate opening of door 102, which rotates from a vertical position, as shown in FIG. 1, to a horizontal position (not shown) as understood by a person of skill in the art. Use of directional terms, such as top, bottom, right, left, front, back, etc. are merely intended to facilitate reference to the various surfaces of the described structures relative to the orientations shown in the drawings and are not intended to be limiting.

As used in this disclosure, the term "mount" includes join, unite, connect, couple, associate, insert, hang, hold, affix, attach, fasten, bind, paste, secure, bolt, screw, rivet, pin, nail, clasp, clamp, cement, fuse, solder, weld, glue, form over, slide together, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact, but are mounted together via intermediate elements). Elements referenced as mounted to each other herein may further be integrally formed together, for example, using a molding process as understood by a person of skill in the art. As a result, elements described herein as being mounted to each other need not be discrete structural elements. The elements may be mounted permanently, removably, or releasably.

Appliance 100 may include a greater or a fewer number of components than those shown in the illustrative embodiments. The one or more components of appliance 100 may be formed of one or more materials, such as various metals, glass, and/or plastics having a sufficient strength and rigidity to support the described application.

In the illustrative embodiment, body 106 includes a plurality of walls that, in combination with door 102, form an enclosed space. The enclosed space may include additional items depending on the type of appliance 100. For example, in the case of a dishwasher type of appliance, the enclosed space may include a tub, a plurality of baskets on which dishes/silverware are placed, plumbing components, one or more spray arms, etc. In the case of a washer type of appliance, the enclosed space may include an agitator, plumbing components, a rotating tub, etc. In the case of a dryer type of appliance, the enclosed space may include an agitator, heating elements, a rotating drum, etc. In the case of a refrigerator type of appliance, the enclosed space may include a plurality of baskets or shelves on which food items are placed, ice making components, cooling components, plumbing components, etc. In the case of an oven type of appliance, the enclosed space may include a plurality of shelves, heating elements, etc.

As understood by a person of skill in the art, the walls that form appliance 100 may include insulation to assist in maintenance of the desired temperature in the enclosed space and/or to suppress noise created by appliance 100. Electrical wiring, electrical circuit boards, various conduits, etc. may further be located in the walls of appliance 100 without limitation.

Figure 2:
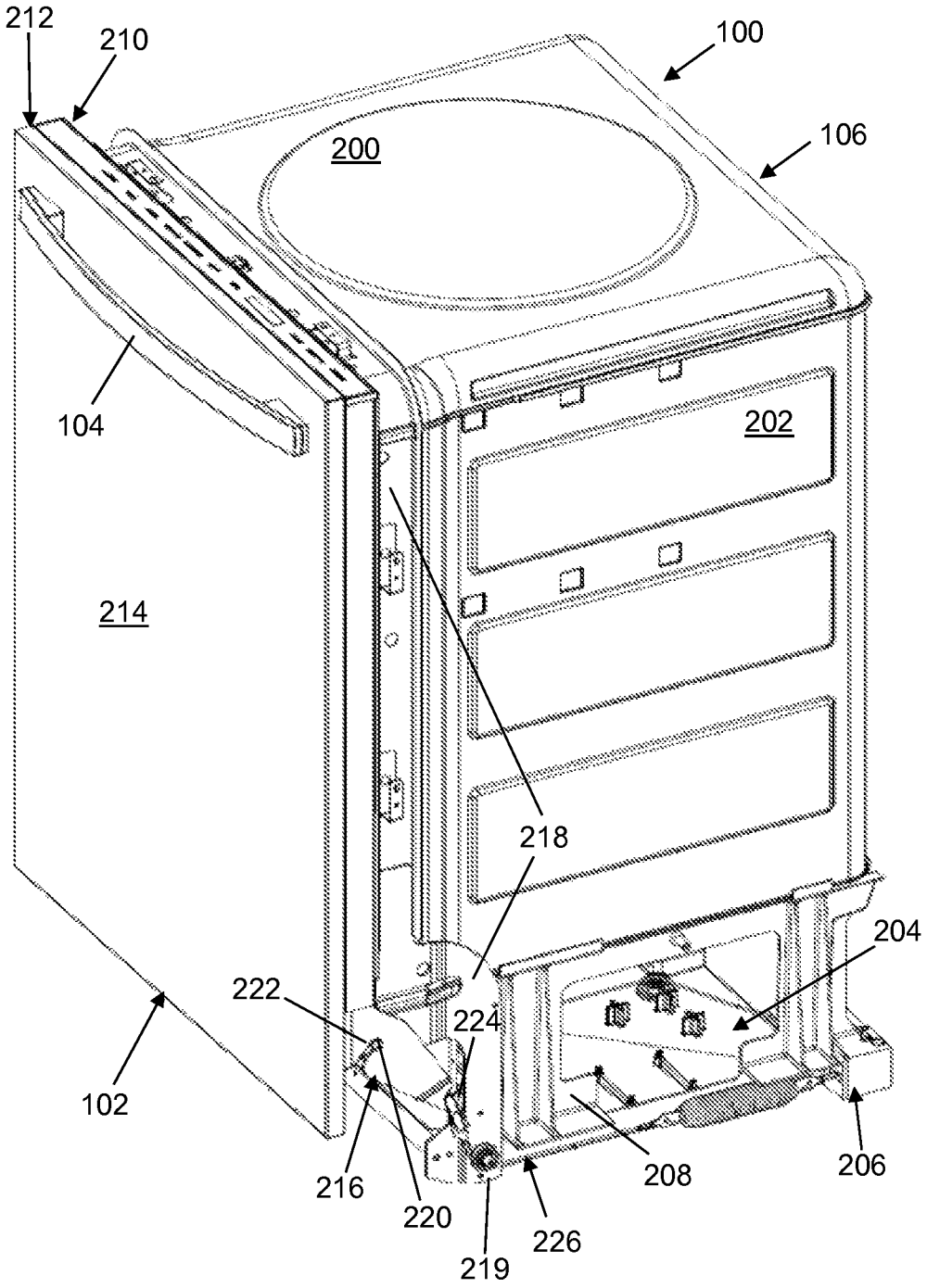
FIG. 2 depicts a front, right, perspective view of the appliance of FIG. 1 in accordance with an illustrative embodiment.

With reference to FIG. 2, the plurality of walls of body 106 may include a top wall 200, a right side wall 202, a left side wall 300 (shown with reference to FIG. 3), a bottom wall 204, a back wall 302 (shown with reference to FIG. 3), and a tub bottom wall (not shown). Top wall 200, right side wall 202, left side wall 300, back wall 302, and the tub bottom wall define a wash tub. Door 102 rotates downward to provide access to the wash tub (not shown) or other enclosed space of appliance 100.

A base 206 may provide a support platform for door 102 and the wash tub, as well as for other components of appliance 100. Base 206 further may define a space below the wash tub (or enclosed space) within which various components may be mounted such as a pump. Base 206 may include a base front wall (not shown), bottom wall 204, a base right side wall 208, a base left side wall 304 (shown with reference to FIG. 3), and a base back wall 306 (shown with reference to FIG. 3). The base front wall, base right side wall 208, base left side wall 304, and base back wall 306 are mounted to extend up from bottom wall 204 and to extend down from the tub bottom wall. The base front wall may be visible from a front of appliance 100. As a result, the base front wall may have a cover plate 108 (shown with reference to FIG. 1) mounted to cover the visible portion of base front wall 902.

Door 102 includes an inner door assembly 210 and an outer door assembly 212 that mounts to inner door assembly 210. Outer door assembly 212 may include an outer panel 214 that is visible from an exterior of appliance 100 when door 102 is in a closed position as shown with reference to FIGS. 1, 2, and 3. As a result, outer panel 214 may be decorative as understood by a person of skill in the art. For example, outer panel 214 may be formed largely of stainless steel, a painted metal, wood, etc.

In the illustrative embodiment, a right hinge 216 and a left hinge 308 (shown with reference to FIG. 3) mount proximate lower edges of inner door assembly 210, and outer door assembly 212 extends lower than right hinge 216 and left hinge 308 so that right hinge 216 and left hinge 308 are not readily visible from a front of appliance 100 when door 102 is in the closed position. In an alternative embodiment, right hinge 216 and left hinge 308 may mount proximate lower edges of outer door assembly 212. Inner door assembly 210 is configured to seal the enclosed space, such as the wash tub, for performance of the operations of appliance 100 as understood by a person of skill in the art.

Figure 3:
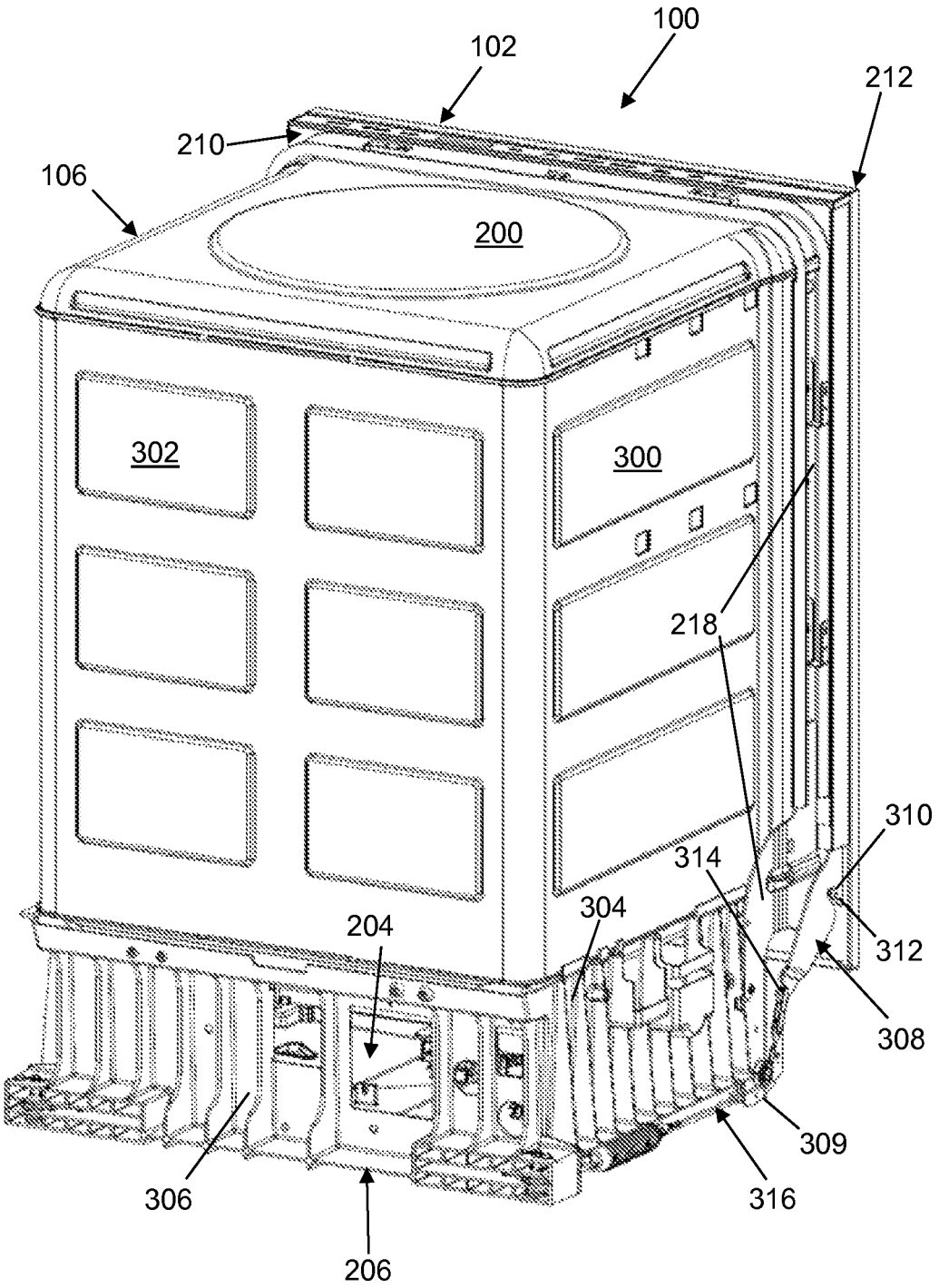
FIG. 3 depicts a back, left, perspective view of the appliance of FIG. 1 in accordance with an illustrative embodiment.

With reference to FIGS. 2 and 3, a collar 218 may extend between a first end 219 mounted on a front, bottom edge of base right side wall 208 and a second end 309 mounted on a front, bottom edge of base left side wall 304 such that collar 218 extends from first end 219 to second end 309 over a front edge of top wall 200. A right hinge pin 220 protrudes from a right side of collar 218. A left hinge pin 310 protrudes from a left side of collar 218. Door 102 rotates about right hinge pin 220 and about left hinge pin 310 when door 102 moves between the open and closed positions. Thus, the axis of right hinge pin 220 and left hinge pin 310 define the axis of rotation of door 102.

With reference to FIG. 2, right hinge 216 pivotally mounts door 102 to body 106 on a right side of door 102 proximate a lower edge of inner door assembly 210. Right hinge 216 may include a mounting slit 222 and a hook 224. Mounting slit 222 of right hinge 216 forms a slit in right hinge 216. Right hinge pin 220 is mounted within mounting slit 222 of right hinge 216. Door 102 rotates about right hinge pin 220 when moving from the open to the closed position or from the closed to the open position. Hook 224 of right hinge 216 extends from right hinge 216 at an end of right hinge 216 generally opposite mounting slit 222 of right hinge 216. Right hinge 216 may be mounted to door 102 using a variety of fasteners or using a variety of mounting methods as understood by a person of skill in the art. Illustrative fasteners include screws and rivets.

Illustrative mounting methods include welding, gluing, etc. A right spring-pulley system 226 may be mounted to hook 224 of right hinge 216 to control a rate of opening or closing of door 102.

With reference to FIG. 3, left hinge 308 pivotally mounts door 102 to body 106 on a left side of door 102 proximate the lower edge of inner door assembly 210. Left hinge 308 may include a mounting slit 312 and a hook 314. Mounting slit 312 of left hinge 308 forms a slit in left hinge 308. Left hinge pin 310 is mounted within mounting slit 312 of left hinge 308. Door 102 rotates about left hinge pin 310 when moving from the open to the closed position or from the closed to the open position. Hook 314 of left hinge 308 extends from left hinge 308 at an end of left hinge 308 generally opposite mounting slit 312 of left hinge 308. Left hinge 308 may be mounted to door 102 using a variety of fasteners or using a variety of mounting methods as understood by a person of skill in the art. Illustrative fasteners include screws and rivets. Illustrative mounting methods include welding, gluing, etc. A left spring-pulley system 316 may be mounted to hook 314 of left hinge 308 to control a rate of opening or closing of door 102.

Figure 4:
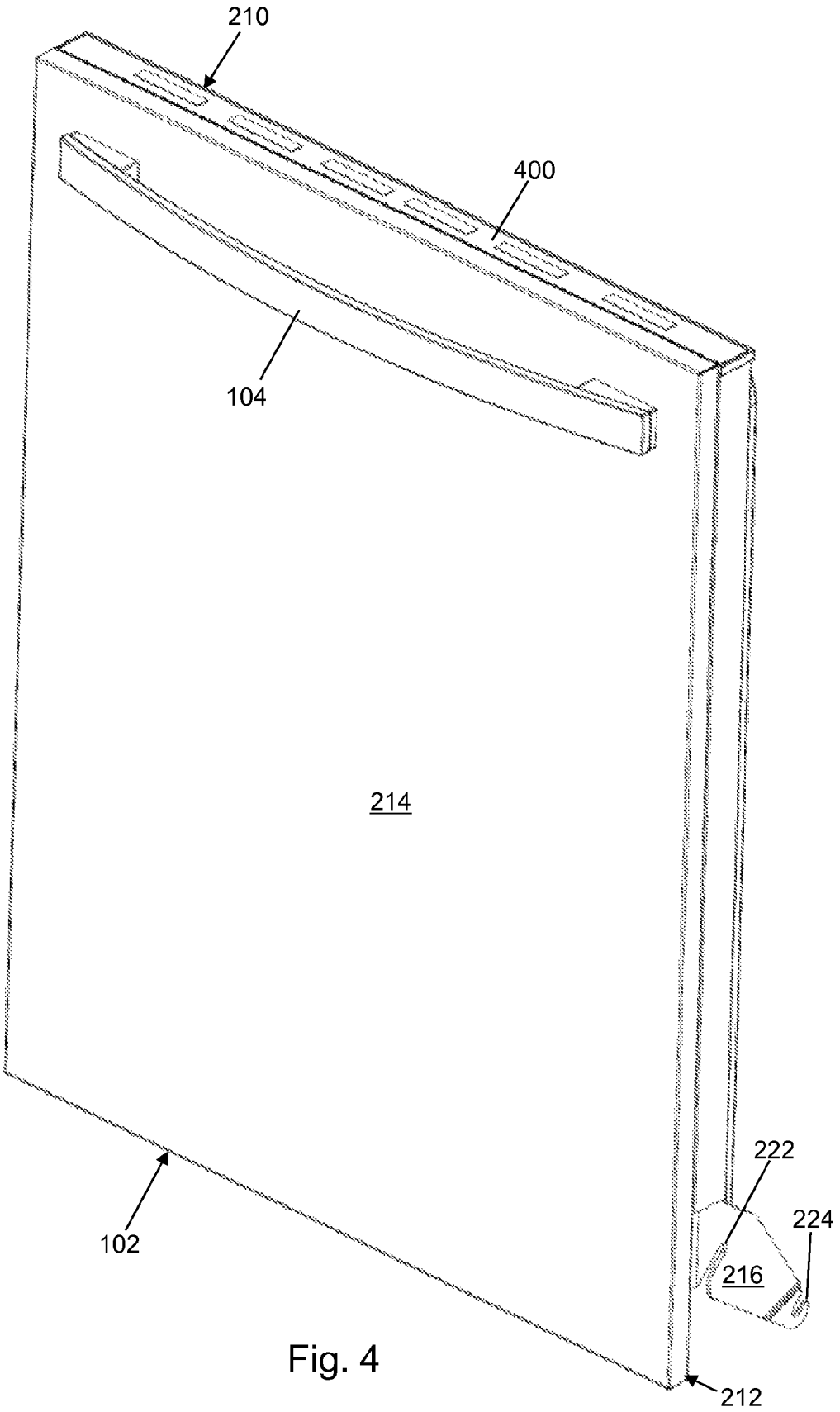
FIG. 4 depicts a front, right, perspective view of a door of the appliance of FIG. 1 in accordance with an illustrative embodiment.

With reference to FIG. 4, a front, right, perspective view of door 102 of appliance 100 is shown in accordance with an illustrative embodiment. A control panel 400 is mounted to a top surface of inner door assembly 210. As understood by a person of skill in the art, control panel 400 provides user interface controls in a variety of formats that allow the consumer to operate appliance 100 and to see a status of operation of appliance 100.

Figure 5:
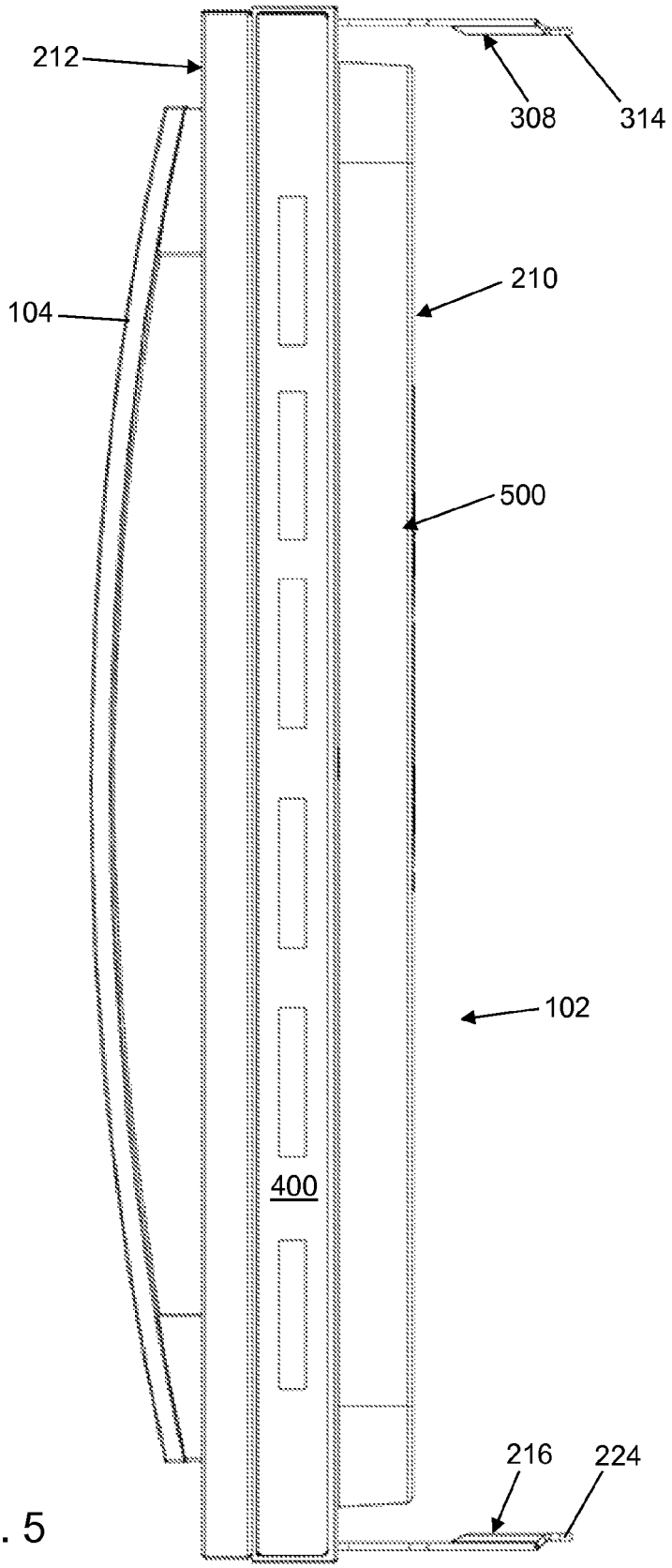
FIG. 5 depicts a top view of the door of FIG. 4 in accordance with an illustrative embodiment.

With reference to FIG. 5, a top side view of door 102 of appliance 100 is shown in accordance with an illustrative embodiment. An inner panel assembly 500 of inner door assembly 210 extends towards the wash tub in a direction opposite handle 104.

Figure 6:
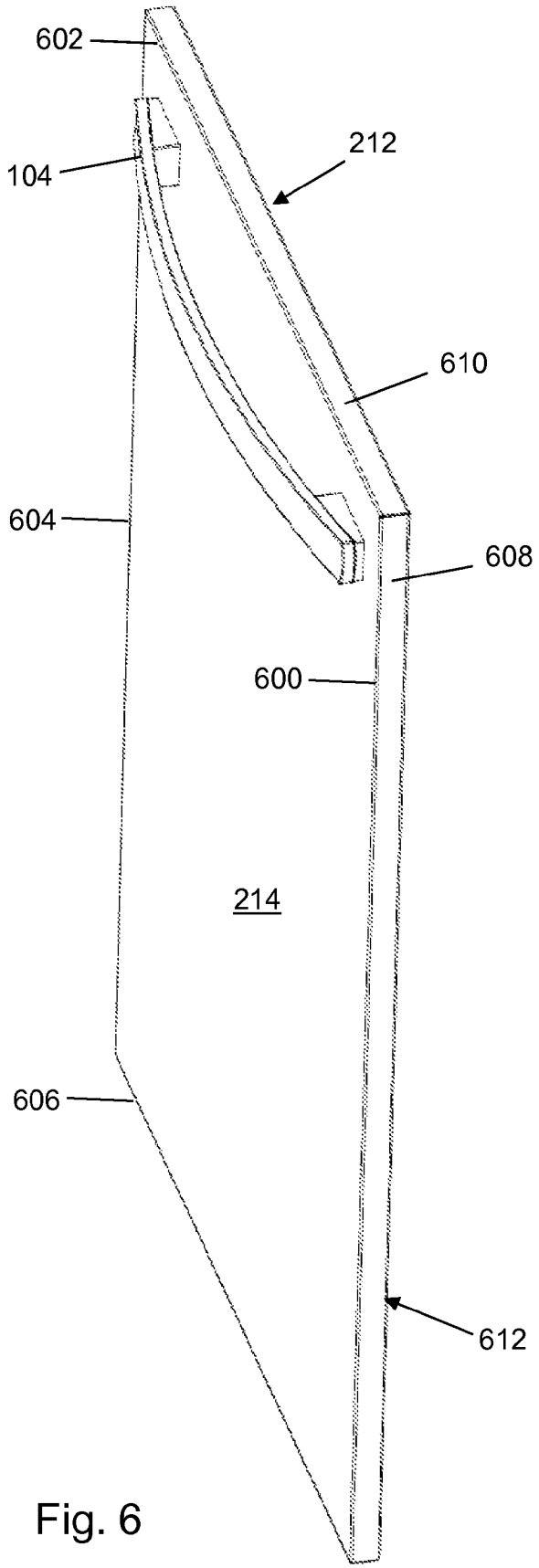
FIG. 6 depicts a front, right, perspective view of an outer door assembly of the door of FIG. 4 in accordance with an illustrative embodiment.
Figure 7:
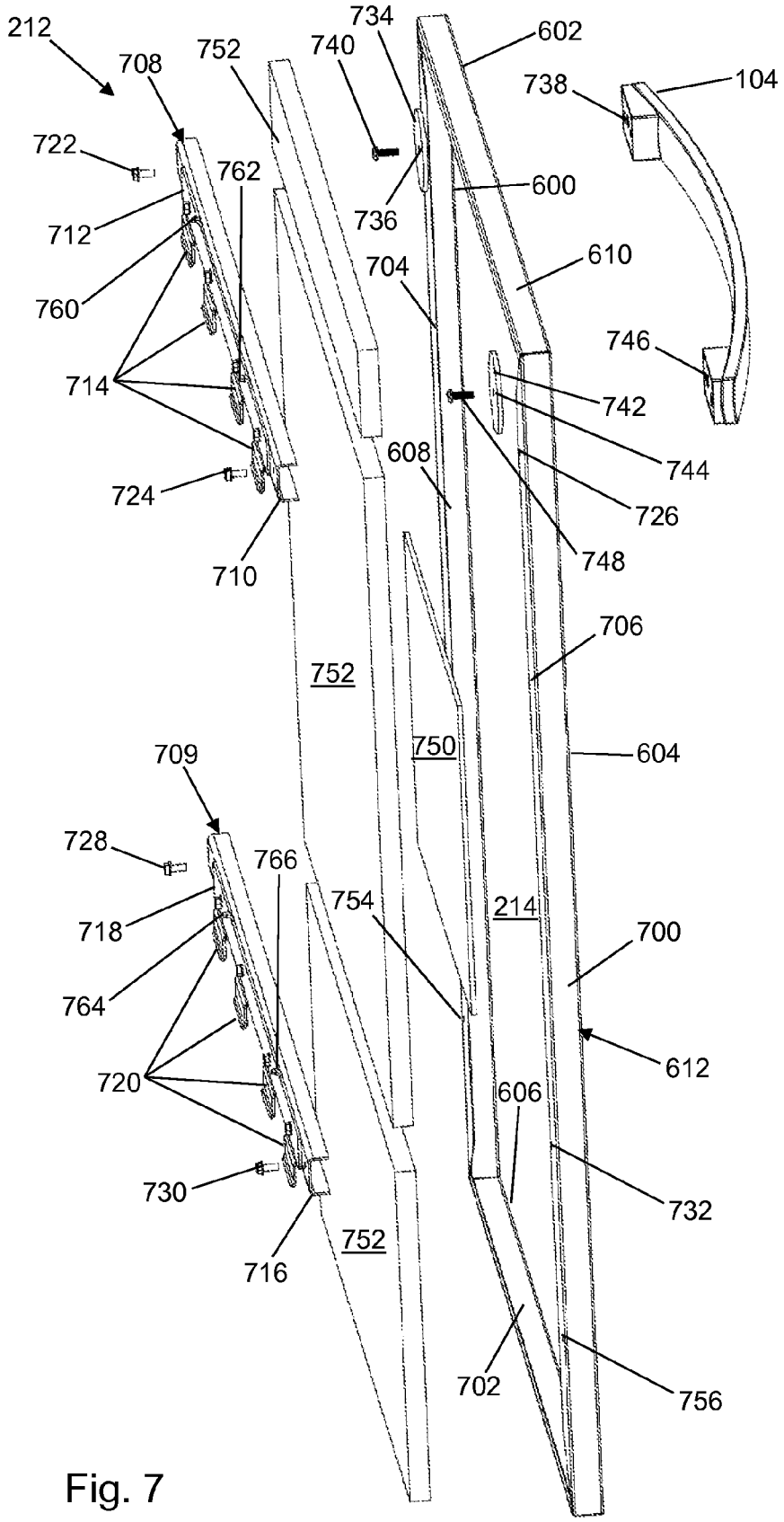
FIG. 7 depicts a left, exploded view of the outer door assembly of FIG. 6 in accordance with an illustrative embodiment.
Figure 8:
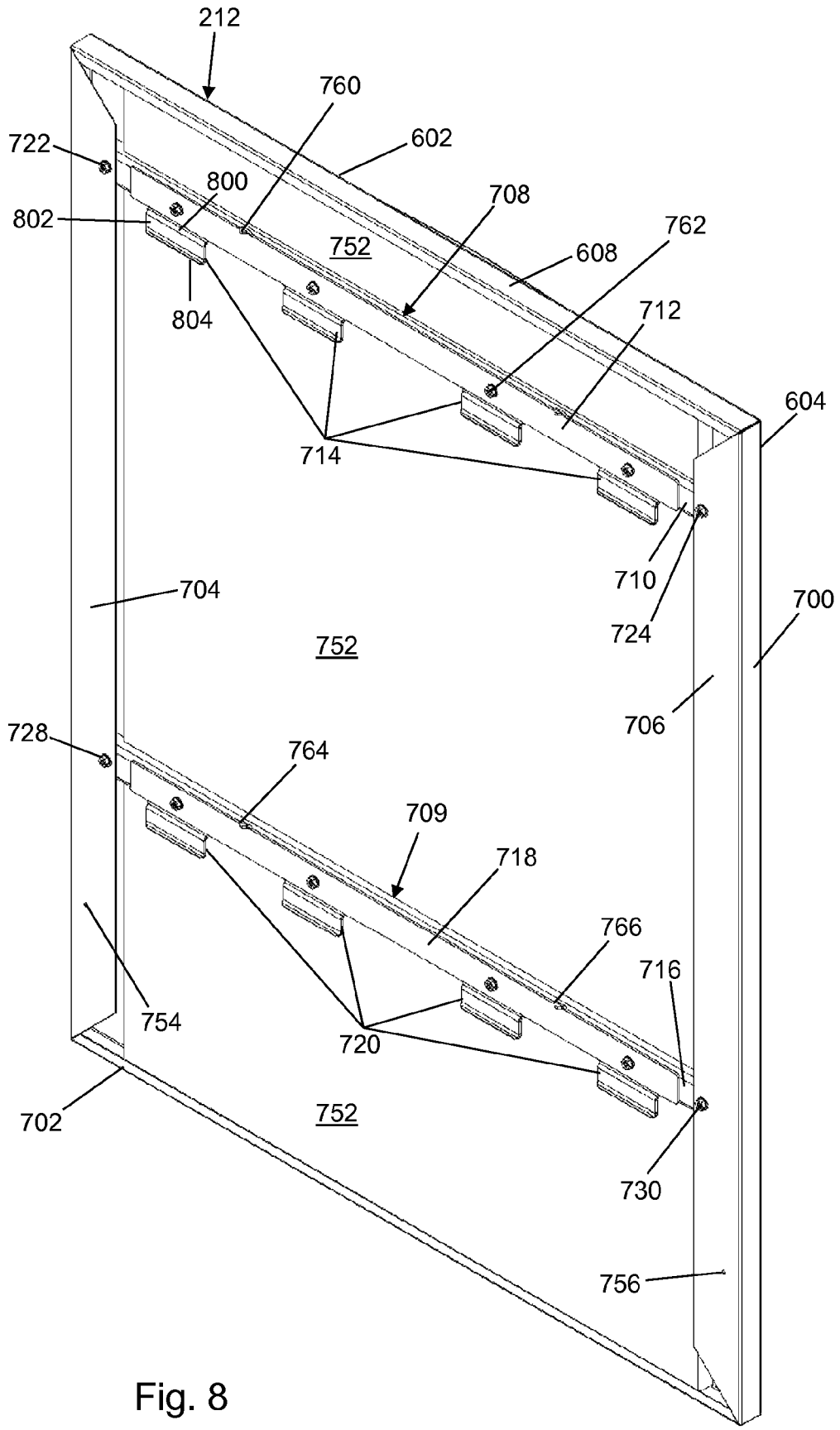
FIG. 8 depicts a back, left, perspective view of the outer door assembly of FIG. 6 in accordance with an illustrative embodiment.

With reference to FIG. 6, a front, right, perspective view of outer door assembly 212 is shown in accordance with an illustrative embodiment. With reference to FIG. 7, a left, exploded view of outer door assembly 212 is shown in accordance with an illustrative embodiment. With reference to FIG. 8, a back, left, perspective view of outer door assembly 212 is shown in accordance with an illustrative embodiment. With reference to FIGS. 6, 7, and 8, outer panel 214 of outer door assembly 212 may include a generally flat and rectangular plate having a right edge 600, a top edge 602, a left edge 604, and a bottom edge 606. In alternative embodiments, outer panel 214 may have other polygonal, elliptical, or circular shapes. As discussed previously, outer panel 214 may be a decorative panel that is formed of stainless steel, a painted metal, a variety of different types of wood, etc.

Outer door assembly 212 further may include a right side flange 608 mounted to extend from right edge 600 of outer panel 214, a top flange 610 mounted to extend from top edge 602 of outer panel 214, a left side flange 700 (shown with reference to FIG. 7) mounted to extend from left edge 604 of outer panel 214, and a bottom flange 702 (shown with reference to FIG. 7) mounted to extend from bottom edge 606 of outer panel 214.

With reference to FIG. 7, outer door assembly 212 further may include a first mounting flange 704, a second mounting flange 706, a top brace 708, and a bottom brace 709. Outer panel 214, right side flange 608, top flange 610, left side flange 700, bottom flange 702, first mounting flange 704, and second mounting flange 706 form an outer panel assembly 612. In the illustrative embodiment, first mounting flange 704 is mounted to extend from right side flange 608 on a side opposite right edge 600 of outer panel 214, and second mounting flange 706 is mounted to extend from left side flange 700 on a side opposite left edge 604 of outer panel 214.

Top brace 708 is mounted to first mounting flange 704 at a first end of top brace 708 and to second mounting flange 706 at a second end of top brace 708 opposite the first end of top brace 708. Bottom brace 709 is mounted to first mounting flange 704 at a first end of bottom brace 709 and to second mounting flange 706 at a second end of bottom brace 709 opposite the first end of bottom brace 709. Outer door assembly 212 may include a fewer or a greater number of braces in alternative embodiments.

In the illustrative embodiment, top brace 708 includes a first hat channel bracket 710, a first cross brace 712, and a first plurality of tabs 714, and bottom brace 709 includes a second hat channel bracket 716, a second cross brace 718, and a second plurality of tabs 720. First cross brace 712 is mounted to first hat channel bracket 710 using fasteners, such as screws or rivets, or other fastening method such as welding, gluing, etc. The first plurality of tabs 714 are mounted to first cross brace 712 to extend downward from top brace 708 below a bottom surface of first hat channel bracket 710 and of first cross brace 712. Second cross brace 718 is mounted to second hat channel bracket 716 using fasteners, such as screws or rivets, or other fastening method such as welding, gluing, etc. The second plurality of tabs 720 are mounted to second cross brace 718 to extend downward from bottom brace 709 below a bottom surface of second hat channel bracket 716 and of second cross brace 718.

A first protrusion 760 and a second protrusion 762 are mounted to extend from first cross brace 712. In the illustrative embodiment, first protrusion 760 extends from a top edge of first cross brace 712 between a right most pair of the first plurality of tabs 714, and second protrusion 762 extends from the top edge of first cross brace 712 between a left most pair of the first plurality of tabs 714. A first protrusion 764 and a second protrusion 766 are mounted to extend from second cross brace 718. In the illustrative embodiment, first protrusion 764 extends from a top edge of second cross brace 718 between a right most pair of the second plurality of tabs 720, and second protrusion 766 extends from the top edge of second cross brace 718 between a left most pair of the second plurality of tabs 720.

With reference to FIG. 8, each tab of the first plurality of tabs 714 and of the second plurality of tabs 720 includes a first curved section 800, a second generally straight section 802, and a second curved section 804. First curved section 800 is mounted to first cross brace 712 though in alternative embodiments, first curved section 800 could be mounted directly to a back surface of outer panel 214 or to first hat channel bracket 710. First curved section 800 curves downward and away from first cross brace 712 in a direction towards inner door assembly 210. Second generally straight section 802 extends downward from first curved section 800. Second curved section 804 curves downward and away from straight section 802 in the direction towards inner door assembly 210.

With continuing reference to FIG. 7, a first fastener 722 and a second fastener 724 are inserted through apertures (not shown) in first hat channel bracket 710 and into a first aperture (not shown) in first mounting flange 704 and into a second aperture 726 in second mounting flange 706, respectively, to mount top brace 708 to outer panel assembly 612. A third fastener 728 and a fourth fastener 730 are inserted through apertures (not shown) in second hat channel bracket 716 and into a third aperture (not shown) in first mounting flange 704 and into a fourth aperture 732 in second mounting flange 706, respectively, to mount bottom brace 709 to outer panel assembly 612. In alternative embodiments, first hat channel bracket 710 could be mounted directly to a back surface of outer panel 214, and/or second hat channel bracket 716 could be mounted directly to a back surface of outer panel 214. Third fastener 728 and fourth fastener 730 may include screws or rivets, or other fastening methods, such as welding, gluing, etc. may be used.

In the illustrative embodiment, handle 104 is attached to outer panel 214 via a first backing plate 734 and a second backing plate 742. An aperture 736 is formed in first backing plate 734, and an aperture 738 is formed in a back face of handle 104. A fifth fastener 740 is inserted through aperture 736 of first backing plate 734 and through aperture 738 of the back face of handle 104 to mount a right end of handle 104 to outer panel 214. An aperture 744 is formed in second backing plate 742, and a second aperture 746 is formed in a second back face of handle 104. A sixth fastener 748 is inserted through aperture 744 of second backing plate 742 and through second aperture 746 of the second back face of handle 104 to mount a left end of handle 104 to outer panel 214. Fifth fastener 740 and sixth fastener 748 may include screws or rivets, or other fastening methods, such as welding, gluing, etc. may be used.

A mastic plate 750 is mounted to a back surface of outer panel 214. Sound insulation 752 is mounted between right side flange 608, top flange 610, left side flange 700, and bottom flange 702 of outer panel assembly 612. In the illustrative embodiment, sound insulation 752 includes three pieces of material though a greater or a fewer number of pieces of material may be used in alternative embodiments. Mastic plate 750, top brace 708, and/or bottom brace 709 maintain sound insulation 752 flush against the back surface of outer panel 214.

A fifth aperture 754 is formed at least partially through first mounting flange 704 below bottom brace 709, and a sixth aperture 756 is formed at least partially through second mounting flange 706 below bottom brace 709 at the same distance above bottom flange 702.

Figure 9:
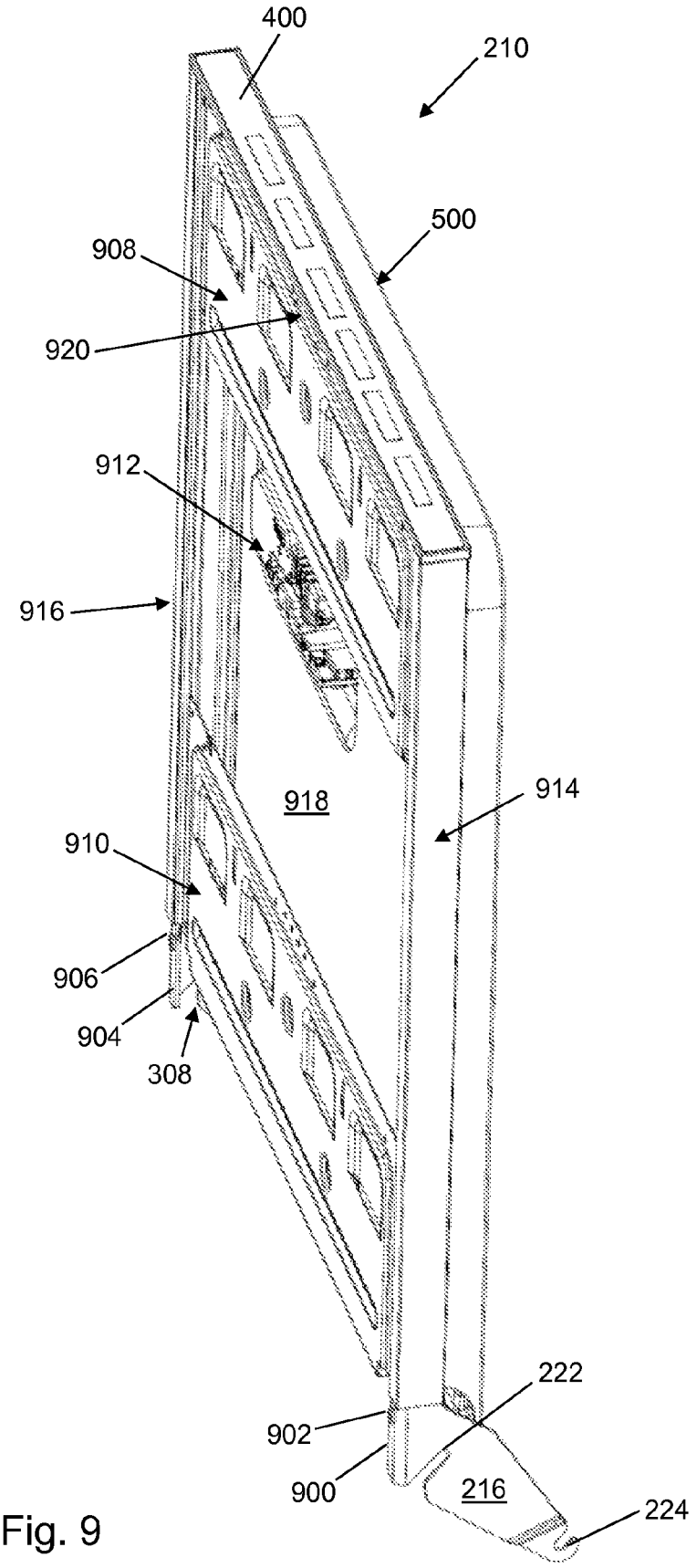
FIG. 9 depicts a front, right, perspective view of an inner door assembly of the door of FIG. 4 in accordance with an illustrative embodiment.

With reference to FIG. 9, a front, right, perspective view of inner door assembly 210 is shown in accordance with an illustrative embodiment. Inner door assembly 210 may include control panel 400, inner panel assembly 500, right hinge 216, left hinge 308, a top brace 908, and a bottom brace 910, a detergent dispenser 912, a right c-channel 914, a left c-channel 916, a mastic liner 918, and a latch 920.

Right hinge 216 may further include a right hinge flange 900. A seventh aperture 902 may be formed in right hinge flange 900. Left hinge 308 may further include a left hinge flange 904. An eighth aperture 906 may be formed in left hinge flange 904. After mounting inner door assembly 210 to outer door assembly 212, a seventh fastener 1700 (shown with reference to FIG. 17) may be inserted in seventh aperture 902, which aligns with fifth aperture 754, and an eighth fastener 1702 (shown with reference to FIG. 17) may be inserted in eighth aperture 906, which aligns with sixth aperture 756.

Figure 10:
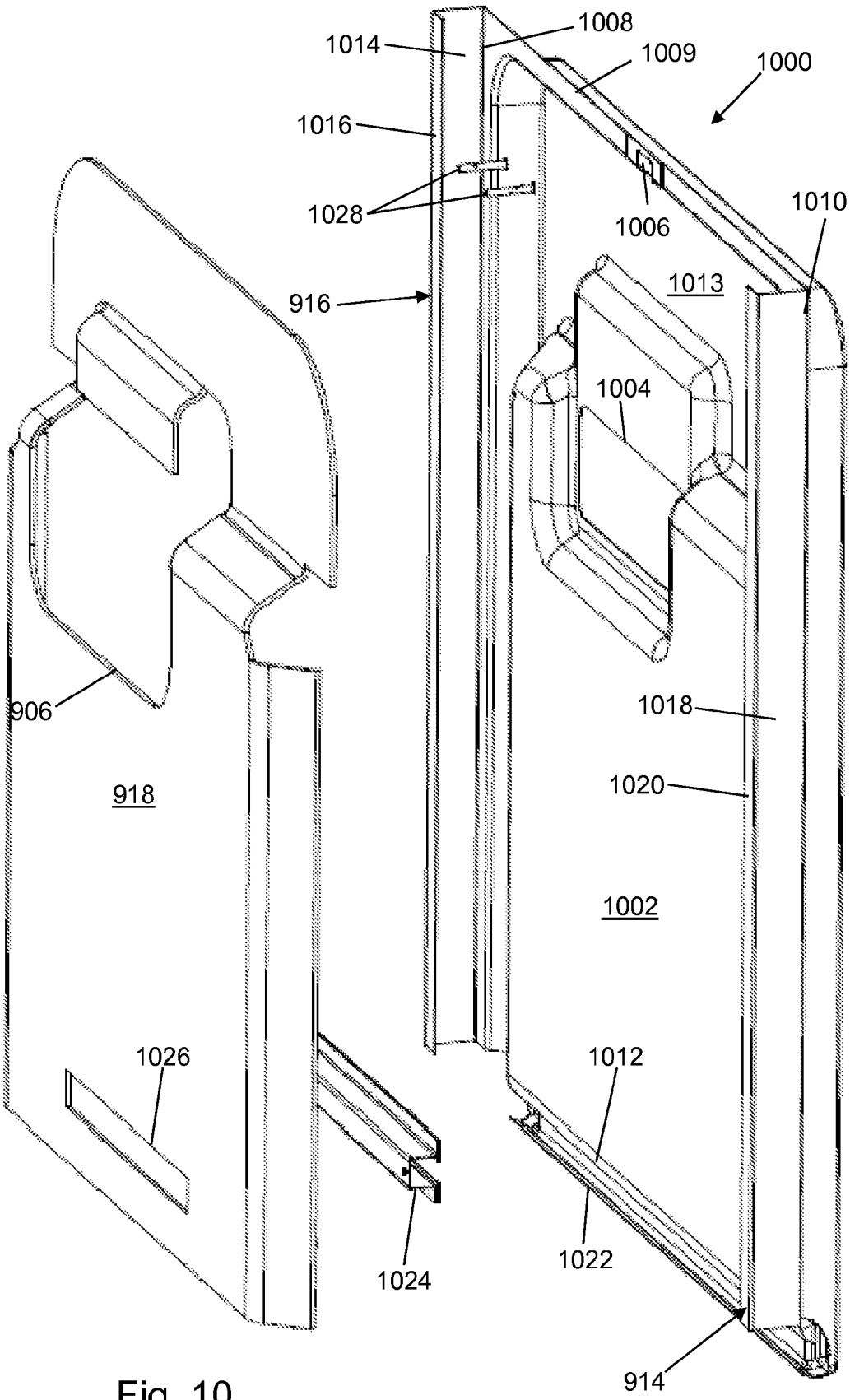
FIG. 10 depicts a left, exploded view of an inner panel sub-assembly of the inner door assembly of FIG. 9 in accordance with an illustrative embodiment.

With reference to FIG. 10, a left, exploded view of an inner panel sub-assembly 1000 of inner panel assembly 500 is shown in accordance with an illustrative embodiment. Inner panel sub-assembly 1000 may include mastic liner 918 and inner liner 1002. Mastic liner 918 is shaped to conform to the shape of inner liner 1002. Mastic liner 918 may be adhered to an inside surface of inner liner 1002 by through heating, pressure, or other methods known to a person of skill in the art. Mastic liner 918 may include a first opening 906 to accommodate mounting of detergent dispenser 912, and a bracket slot 1026.

Figure 11:
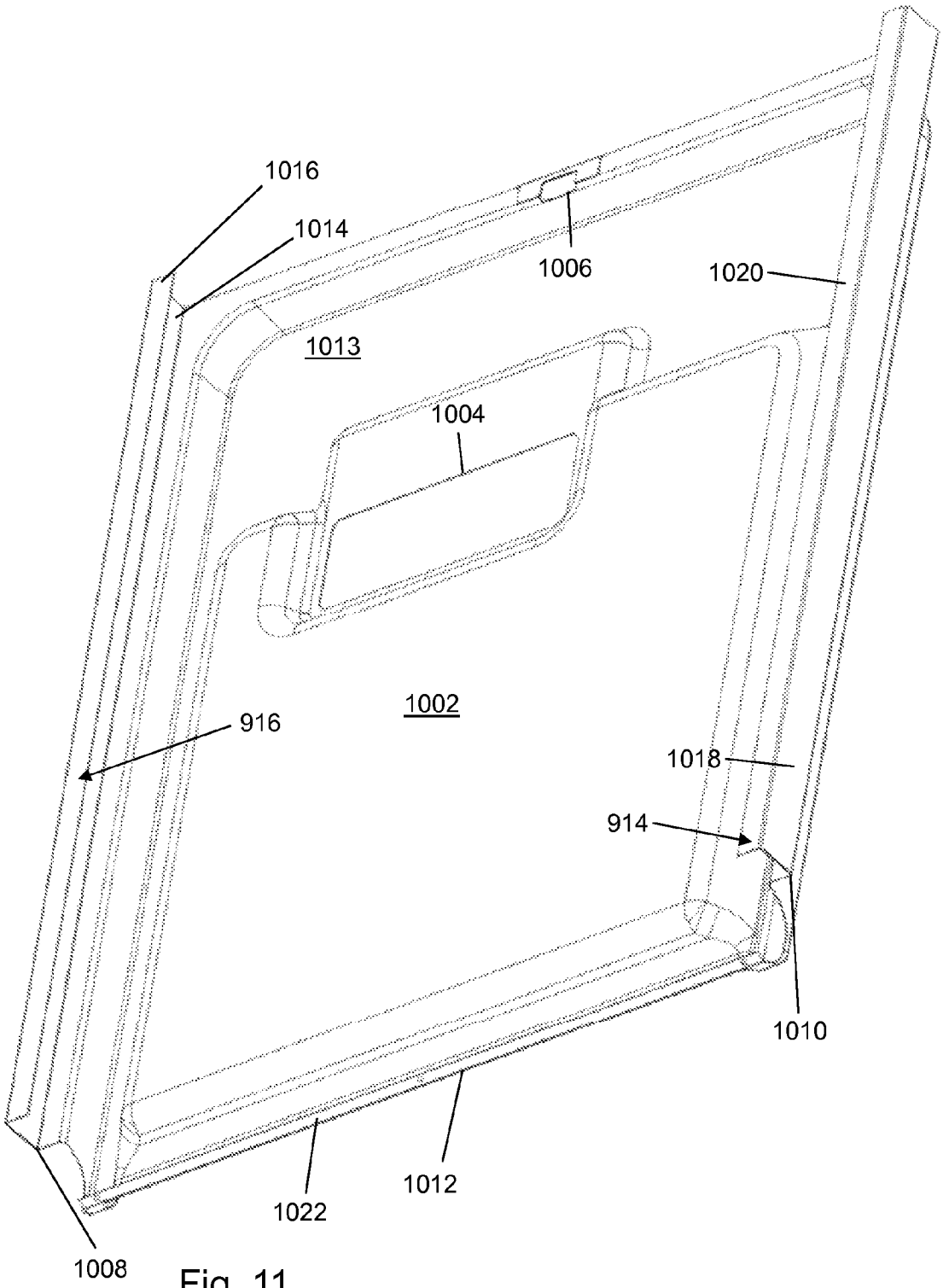
FIG. 11 depicts a bottom, perspective view of an inner liner of the inner panel of FIG. 10 in accordance with an illustrative embodiment.

With reference to FIG. 11, a bottom, perspective view of inner liner 1002 of inner panel sub-assembly 1000 is shown in accordance with an illustrative embodiment. With reference to FIGS. 10 and 11, inner liner 1002 includes a dispenser aperture 1004, a latch aperture 1006, a left edge 1008, a top edge 1009, a right edge 1010, and a bottom edge 1012. Inner liner 1002 of inner panel sub-assembly 1000 may include a generally rectangular plate with a cavity 1013 that extends towards an interior of appliance 100. Wiring, printed circuit boards, etc. for control panel 400, detergent dispenser 912, and latch 920 may be placed within cavity 1013. In alternative embodiments, inner liner 1002 may have other polygonal, elliptical, or circular shapes.

Inner panel sub-assembly 1000 further may include a left side flange 1014, a left interior flange 1016, a right side flange 1018, a right interior flange 1020, and a bottom flange 1022. Right side flange 1018 is mounted to extend from right edge 1010 of inner liner 1002. Left side flange 1014 is mounted to extend from left edge 1008 of inner liner 1002. Bottom flange 1022 is mounted to extend from bottom edge 1012 of inner liner 1002. Left interior flange 1016 is mounted to extend from left side flange 1014 on a side opposite left edge 1008 of inner panel sub-assembly 1000. Right interior flange 1020 is mounted to extend from right side flange 1018 on a side opposite right edge 1010 of inner panel sub-assembly 1000. Left side flange 1014 and left interior flange 1016 form left c-channel 916 along left edge 1008 of inner liner 1002. Right side flange 1018 and right interior flange 1020 form right c-channel 914 along right edge 1010 of inner liner 1002.

A panel connection bracket 1024 may be attached to inner liner 1002, for example, using two sided tape such as very high bond tape. Bracket slot 1026 may be sized and shaped to allow panel connection bracket 1024 to extend through mastic liner 918.

On the top cross section of inner liner 1002, a small section is hemmed over completely where a pair of door latch studs 1028 may be welded in place. This hem prevents burn through from showing on the inner visible surface of door 102.

Figure 12:
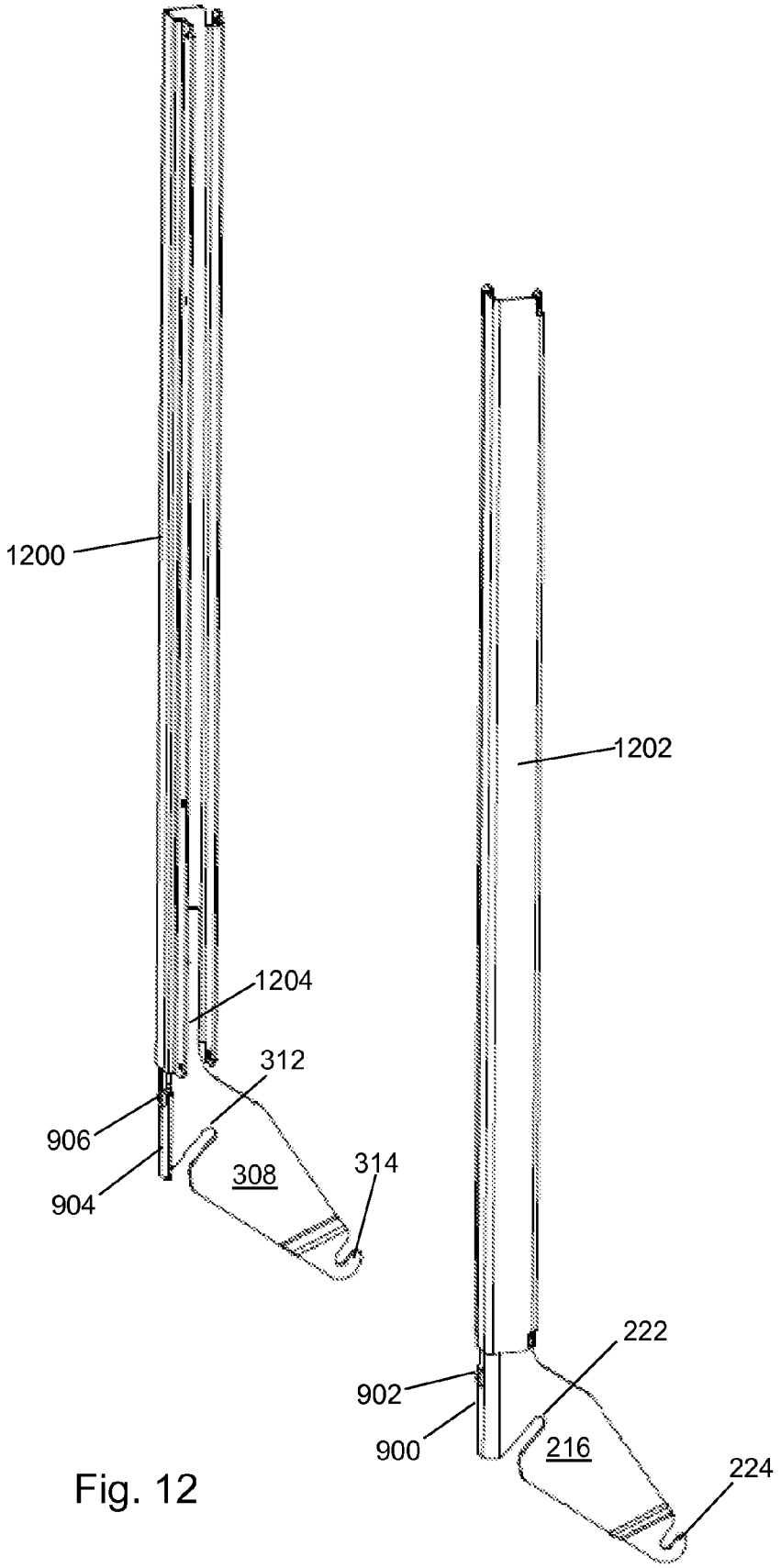
FIG. 12 depicts a right, perspective view of channel bracket/hinge assemblies of the inner door assembly of FIG. 9 in accordance with an illustrative embodiment.

With reference to FIG. 12, a left channel bracket 1200, a right channel bracket 1202, left hinge 308, and right hinge 216 are shown. An extension 1204 of left hinge 308 is inserted within left channel bracket 1200 to mount left hinge 308 to left channel bracket 1200 though other mounting methods may be used. Similarly, a second extension (not shown) of right hinge 216 is inserted within right channel bracket 1202 to mount right hinge 216 to right channel bracket 1202 though other mounting methods may be used. For example, right hinge 216 may be welded to right channel bracket 1202, and left hinge 308 may be welded to left channel bracket 1200. Right channel bracket 1202 is inserted into right c-channel 914 of inner liner 1002. Right channel bracket 1202 and right c-channel 914 may be welded in plane on a back return flange of right channel bracket 1202, which is not visible to the consumer. Left channel bracket 1200 is inserted into left c-channel 916 of inner liner 1002. Left channel bracket 1200 and left c-channel 916 may be welded in plane on a back return flange of left channel bracket 1200, which is not visible to the consumer.

Figure 13:
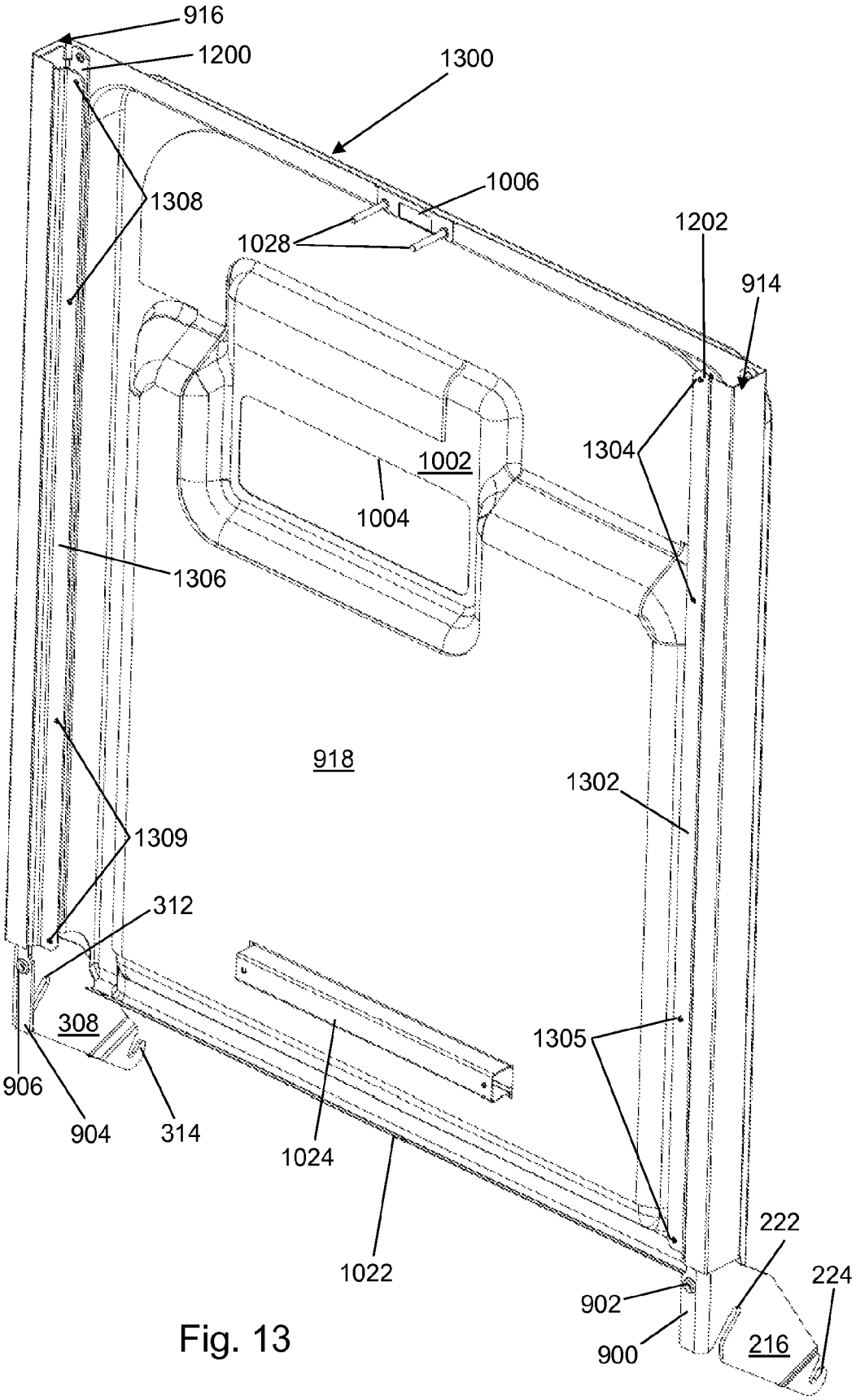
FIG. 13 depicts a right, perspective view of a panel assembly of the inner door assembly of FIG. 9 in accordance with an illustrative embodiment.

With reference to FIG. 13, an inner panel assembly 1300 is shown in accordance with an illustrative embodiment. Inner panel assembly 1300 may include right hinge 216, left hinge 308, right c-channel 914, left c-channel 916, mastic liner 918, inner liner 1002, panel connection bracket 1024, the pair of door latch studs 1028, right channel bracket 1202, and left channel bracket 1200. A right external flange 1302 of right channel bracket 1202 includes a right top pair of apertures 1304 and a right bottom pair of apertures 1305. Right external flange 1302 extends generally perpendicularly from right channel bracket 1202 towards an interior of inner panel assembly 1300. A left external flange 1306 of left channel bracket 1200 includes a left top pair of apertures 1308 and a left bottom pair of apertures 1309. Left external flange 1306 extends generally perpendicularly from left channel bracket 1200 towards the interior of inner panel assembly 1300.

Figure 14A:
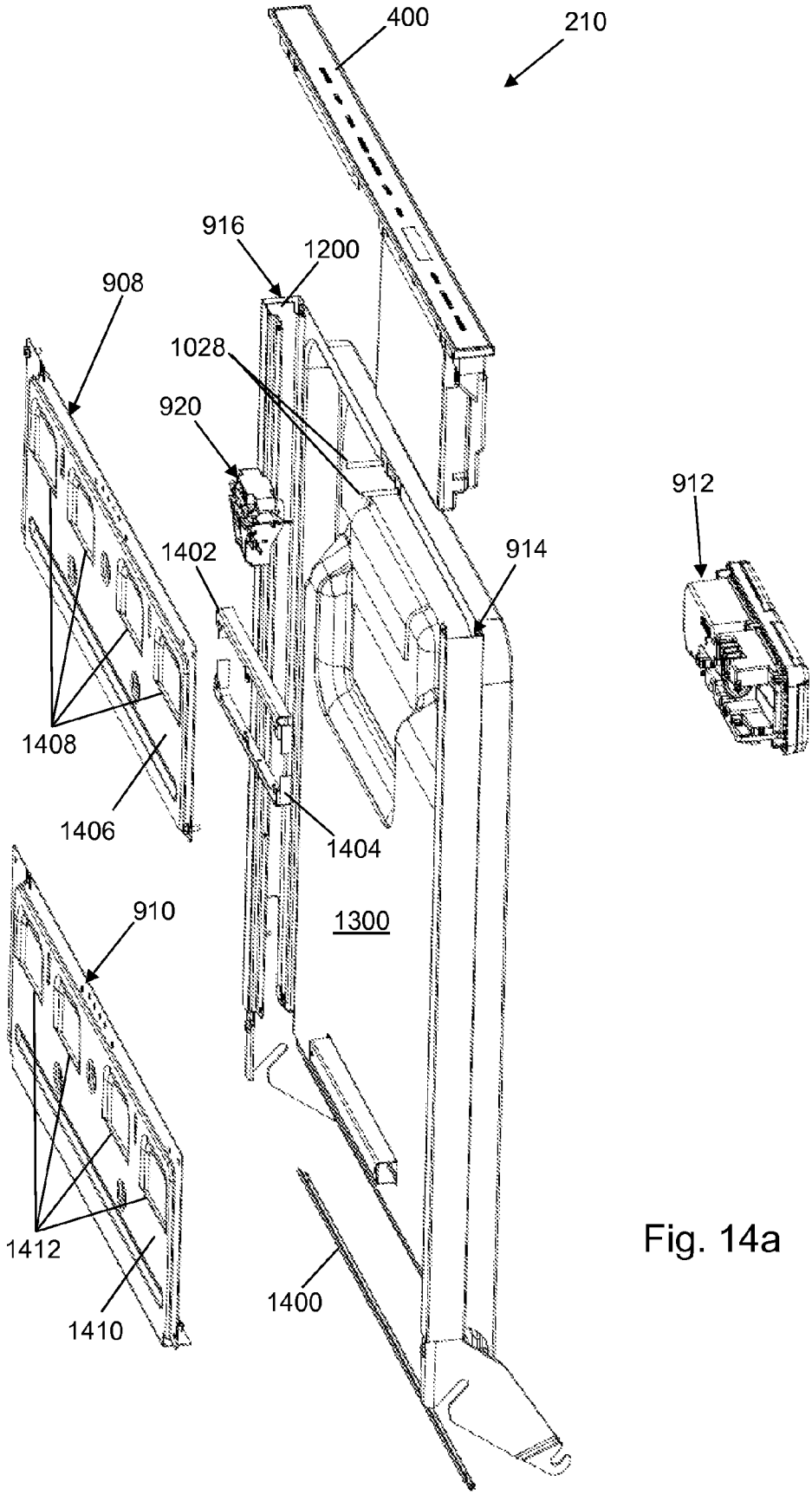
FIG. 14*a* depicts a right, partially exploded view of the inner door assembly of FIG. 9 in accordance with an illustrative embodiment.

With reference to FIG. 14*a*, a right, partially exploded view of inner door assembly 210 is shown in accordance with an illustrative embodiment. Inner door assembly 210 may include inner panel assembly 1300, control panel 400, top brace 908, bottom brace 910, detergent dispenser 912, latch 920, a seal 1400, a first dispenser bracket 1402, and a second dispenser bracket 1404. Seal 1400 is mounted to bottom flange 1022 of inner liner 1002. Detergent dispenser 912 is mounted to inner panel assembly 1300 by first dispenser bracket 1402 and second dispenser bracket 1404 and fasteners (not shown) as understood by a person of skill in the art. Control panel 400 mounts to inner panel assembly 1300 by sliding in place within right c-channel 914 and left c-channel 916. Latch 920 slides over the pair of door latch studs 1028. Sound insulation (not shown) may be placed on one or more portions of inner panel assembly 1300. A wire harness (not shown) may be attached to control panel 400, latch 920, and/or detergent dispenser 912 and positioned within cavity 1013.

In the illustrative embodiment, top brace 908 includes a first plate 1406 and a first plurality of slots 1408, and bottom brace 910 includes a second plate 1410 and a second plurality of slots 1412. The first plurality of slots 1408 are formed through first plate 1406. Each slot of the first plurality of slots 1408 is sized and shaped to accommodate a tab of the first plurality of tabs 714 when the inner door assembly 210 is mounted to the outer door assembly 212. The second plurality of slots 1412 are formed through second plate 1410. Each slot of the second plurality of slots 1412 is sized and shaped to accommodate a tab of the second plurality of tabs 720 when the inner door assembly 210 is mounted to the outer door assembly 212. Each slot of the first plurality of slots 1408 and of the second plurality of slots 1412 includes a lower edge 1424 that is sloped downwards towards mastic liner 918.

Figure 14B:
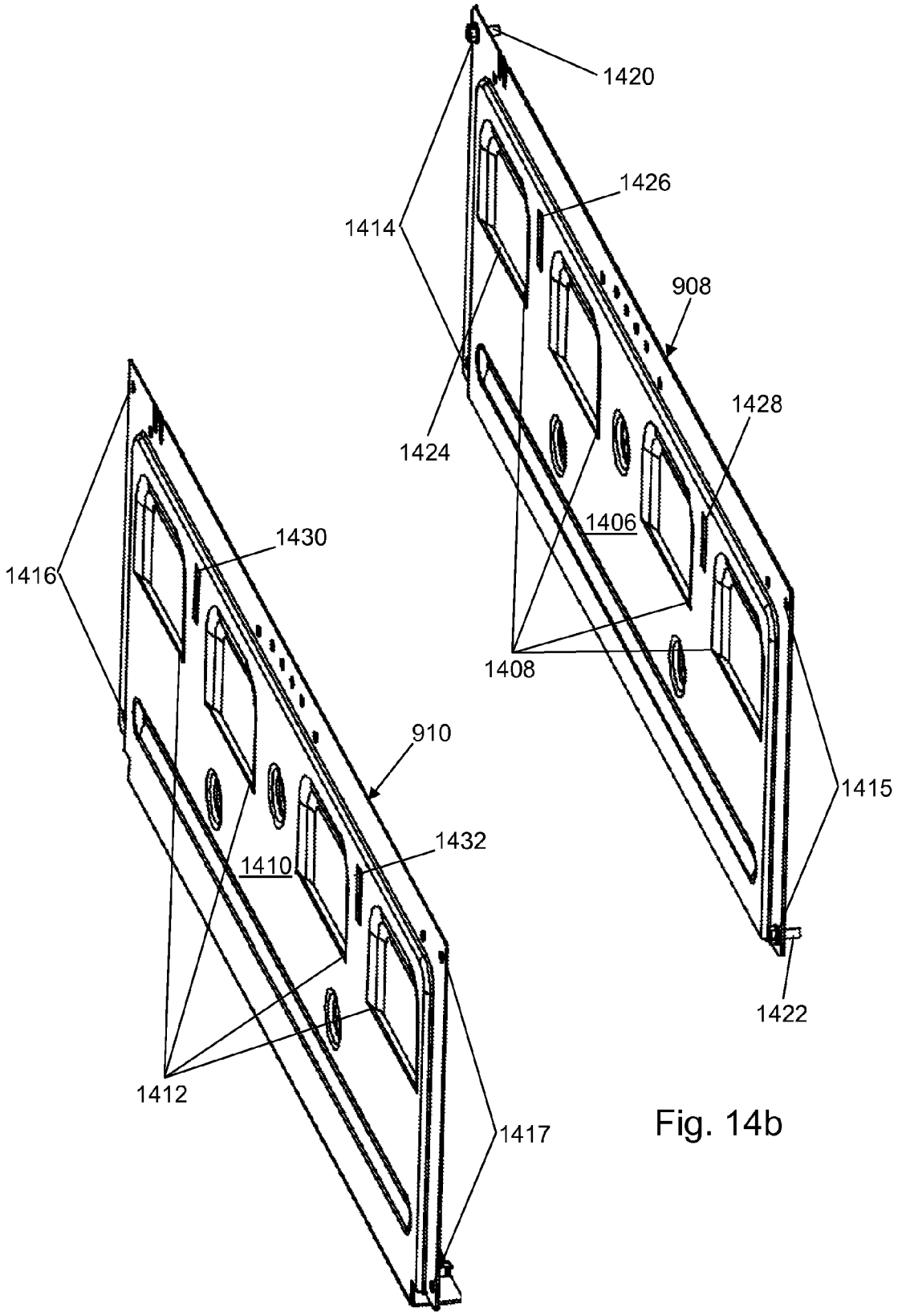
FIG. 14*b* depicts a right side perspective view of a top brace and a bottom brace of the inner door assembly of FIG. 14*a* in accordance with an illustrative embodiment.

With reference to FIG. 14*b*, a right, perspective view of top brace 908 and bottom brace 910 is shown in accordance with an illustrative embodiment. A left pair of apertures 1414 and a right pair of apertures 1415 are formed through first plate 1406 proximate each corner of first plate 1406. A left pair of apertures 1416 and a right pair of apertures 1417 are formed through second plate 1410 proximate each corner of second plate 1410. Top brace 908 is mounted between right external flange 1302 of right channel bracket 1202 and left external flange 1306 of left channel bracket 1200 using fasteners, such as a first screw 1420 and a second screw 1422, that are inserted through the left pair of apertures 1414 and the right pair of apertures 1415 of first plate 1406 and through the left top pair of apertures 1308 of left external flange 1306 and the right top pair of apertures 1304 of right external flange 1302, respectively. Bottom brace 910 is mounted between right external flange 1302 of right channel bracket 1202 and left external flange 1306 of left channel bracket 1200 using fasteners that are inserted through the left pair of apertures 1416 and the right pair of apertures 1417 of second plate 1410 and through the left bottom pair of apertures 1309 of left external flange 1306 and the right bottom pair of apertures 1305 of right external flange 1302, respectively. Alternative fasteners or mounting methods may be used.

A left vertical slit 1426 is formed through first plate 1406 between a left most pair of the first plurality of slots 1408. A right vertical slit 1428 is formed through first plate 1406 between a right most pair of the first plurality of slots 1408. A left vertical slit 1430 is formed through second plate 1410 between a left most pair of the second plurality of slots 1412. A right vertical slit 1432 is formed through second plate 1410 between a right most pair of the second plurality of slots 1412. In an illustrative embodiment, second protrusion 762 of first cross brace 712 is inserted in left vertical slit 1426 of first plate 1406 and first protrusion 760 of first cross brace 712 is inserted in right vertical slit 1428 of first plate 1406, and second protrusion 766 of second cross brace 718 is inserted in left vertical slit 1430 of second plate 1410 and first protrusion 764 of second cross brace 718 is inserted in right vertical slit 1432 of second plate 1410 to minimize side to side movement.

Figure 15:
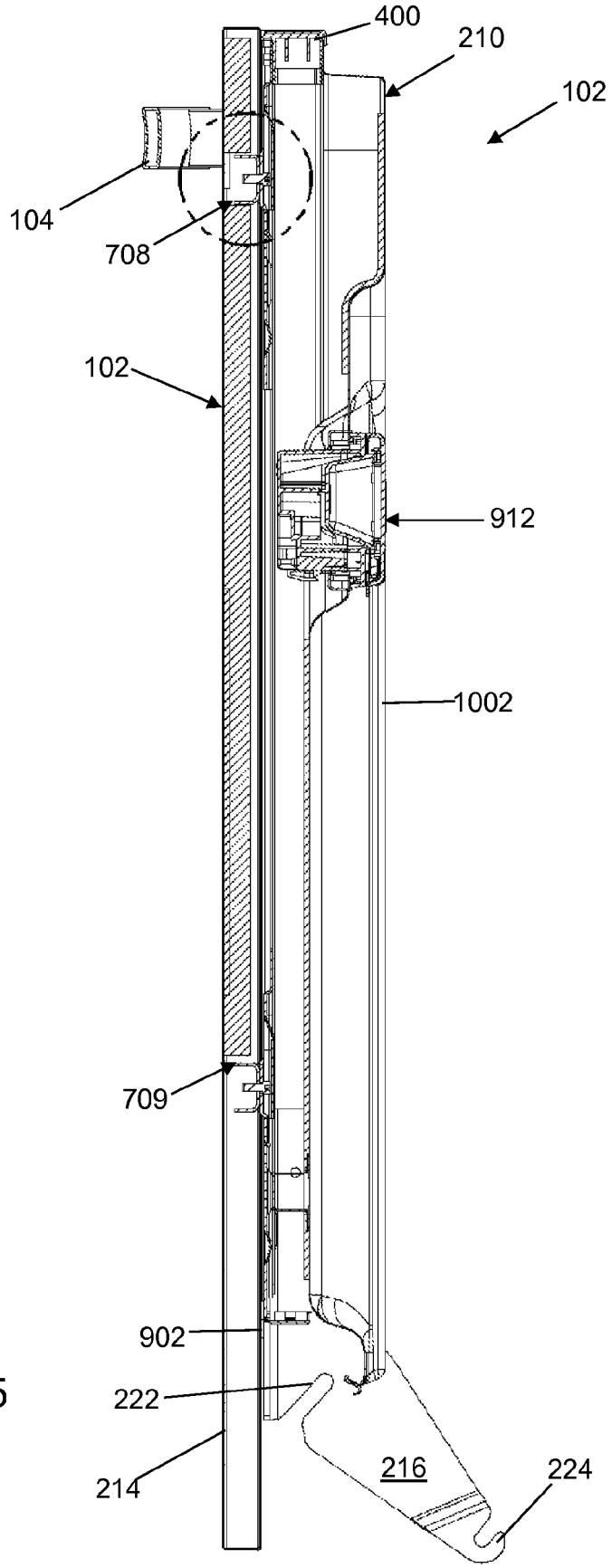
FIG. 15 depicts a right, cross sectional view of the door of FIG. 4 in accordance with an illustrative embodiment.

With reference to FIG. 15, a right, cross sectional view of door 102 is shown in accordance with an illustrative embodiment. To mount inner door assembly 210 and outer door assembly 212 together, the first plurality of tabs 714 and the second plurality of tabs 720 are aligned with and inserted into respective ones of the first plurality of slots 1408 and the second plurality of slots 1412.

Figure 16:
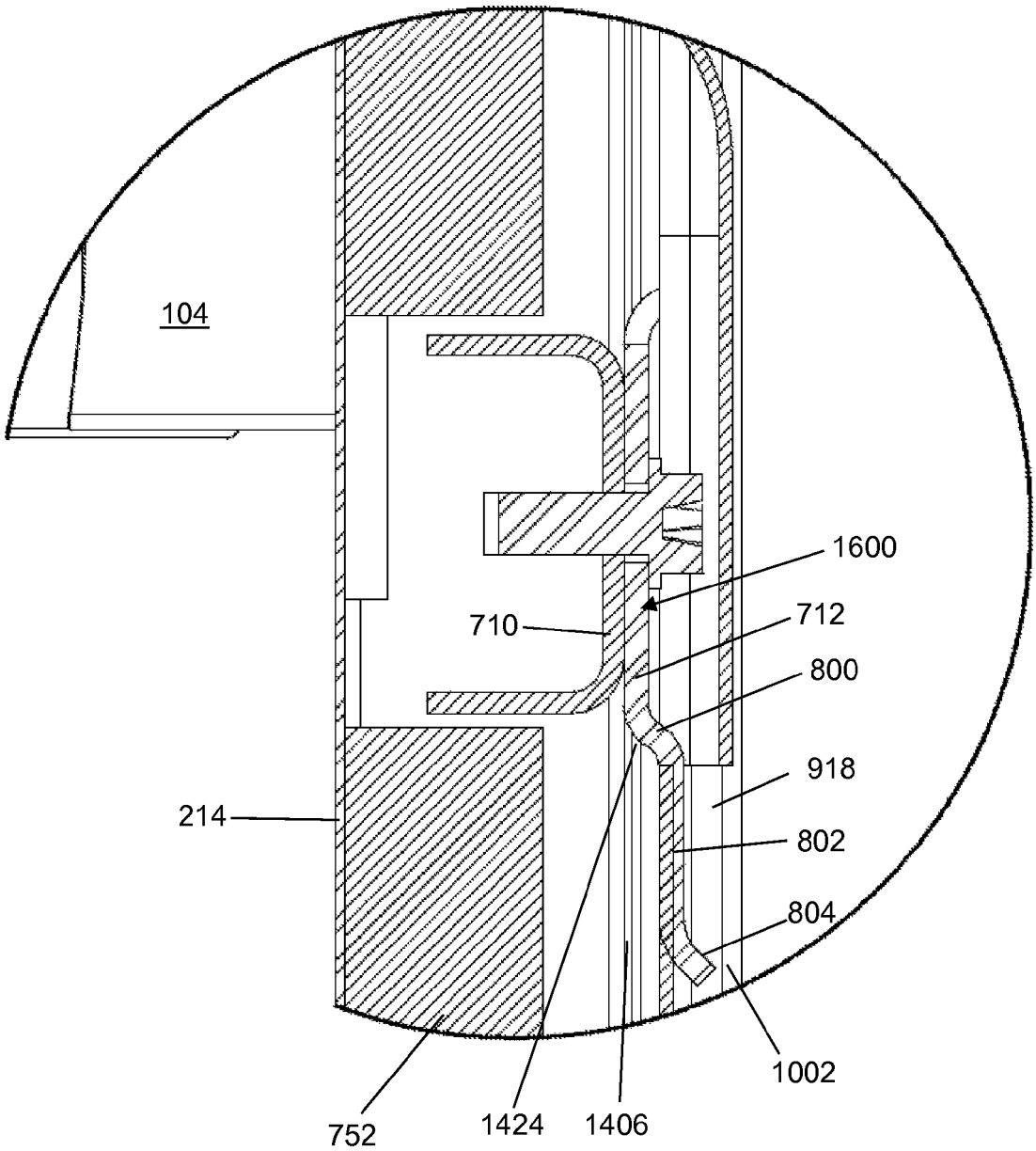
FIG. 16 depicts the right, cross sectional view of FIG. 15 zoomed to show a tab inserted in a slot in accordance with an illustrative embodiment.

With reference to FIG. 16, the right, cross sectional view of FIG. 15 is zoomed to show a tab inserted in a slot in accordance with an illustrative embodiment. A tab 1600 of the first plurality of tabs 714 is shown inserted in a slot of the first plurality of slots 1408. As tab 1600 is inserted into the associated slot, second curved section 804 slides down along lower edge 1424 until first curved section 800 of tab 1600 abuts lower edge 1424. Thus, gravity acts as an aid in holding inner door assembly 210 and outer door assembly 212 mounted together. First curved section 800 of tab 1600 pulls inner door assembly 210 and outer door assembly 212 together tightly.

Figure 17:
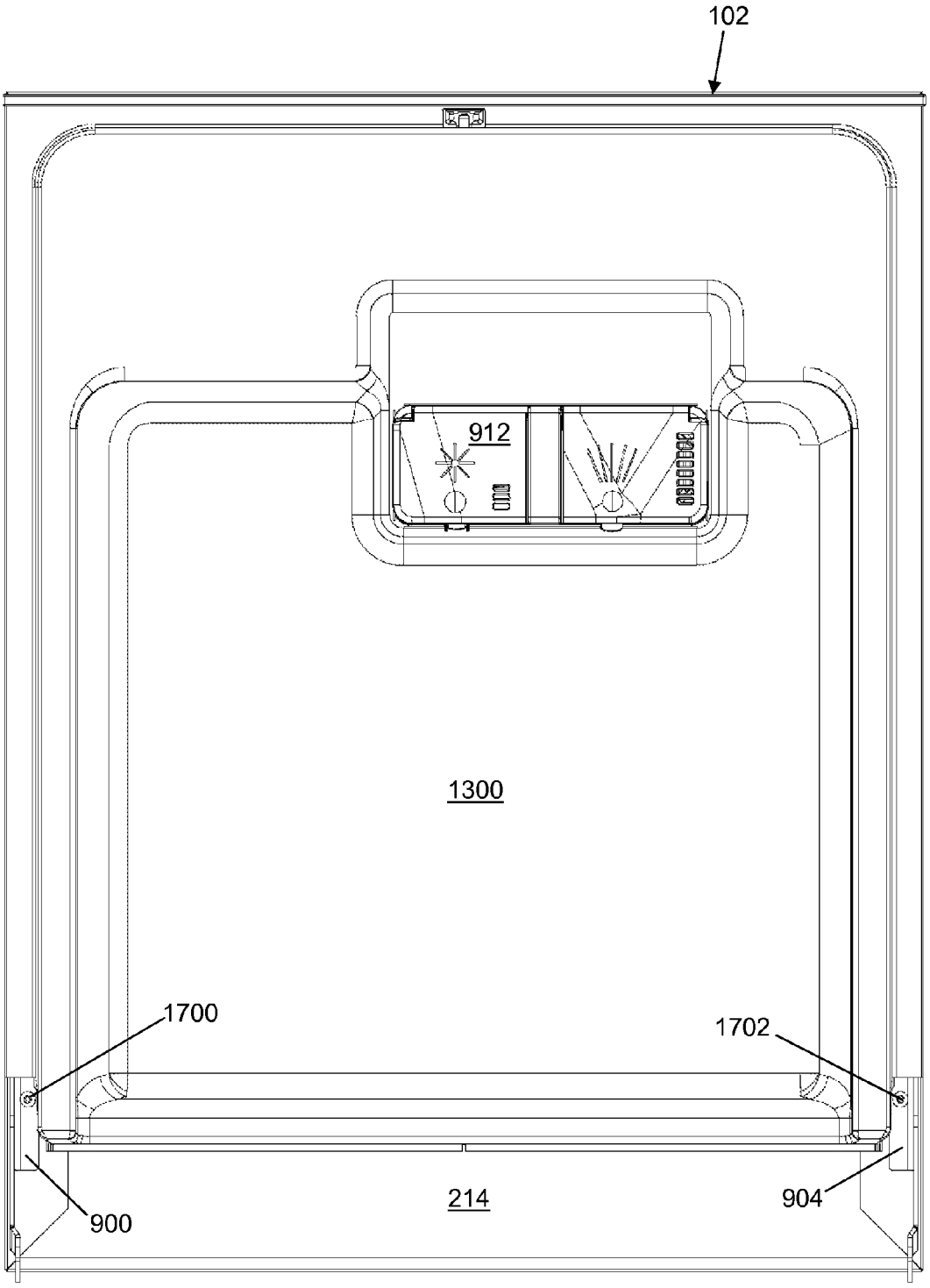
FIG. 17 depicts a back view of the inner door assembly of FIG. 9 in accordance with an illustrative embodiment.

With reference to FIG. 17, a back view of door 102 is shown in accordance with an illustrative embodiment. To further ensure that inner door assembly 210 and outer door assembly 212 do not slide apart vertically, seventh fastener 1700 may be inserted in seventh aperture 902, which aligns with fifth aperture 754, and eighth fastener 1702 may be inserted in eighth aperture 906, which aligns with sixth aperture 756. Seventh fastener 1700 and eighth fastener 1702 may further be inserted into clip nuts inserted in fifth aperture 754 and sixth aperture 756.

By using clip nuts, seventh fastener 1700 and eighth fastener 1702 can be removed and replaced easily in the event that seventh fastener 1700 and eighth fastener 1702 or the clip nuts become damaged. Thus, a significant amount of money and time can be saved by the consumer. In addition, outer panel 214 can be easily replaced, for example, with a custom wood panel. No intermediate panel or brackets are needed to install a custom wood panel, nor is any special routing of the wood panel necessary. In an illustrative embodiment, first cross brace 712 and second cross brace 718 may be mounted directly to the custom wood panel. Additionally, because seventh fastener 1700 and eighth fastener 1702 do not penetrate inner liner 1002, a clean surface is provided to the consumer that is easy to clean.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A door comprising:

a first door assembly comprising a first panel assembly comprising a first panel;

a left side flange mounted to extend from a left edge of the first panel; and a right side flange mounted to extend from a right edge of the first panel;

a first brace mounted between the left side flange of the first panel assembly and the right side flange of the first panel assembly; and a plurality of tabs mounted to extend from the first brace;

a second door assembly mounted to the first door assembly, the second door assembly comprising a second panel assembly comprising a second panel;

a left side flange mounted to extend from a left edge of the second panel; and a right side flange mounted to extend from a right edge of the second panel;

a second brace mounted between the left side flange of the second panel assembly and the right side flange of the second panel assembly; and a plurality of slots formed in the second brace;

a left hinge mounted to either the left side flange of the first panel assembly or the left side flange of the second panel assembly, wherein the left hinge is configured to mount the door to a body of an appliance; and a right hinge mounted to either the right side flange of the first panel assembly or the right side flange of the second panel assembly, wherein the right hinge is configured to mount the door to the body of the appliance;

wherein the plurality of tabs are configured to align with and to slide down into respective ones of the plurality of slots to mount the first door assembly to the second door assembly.

2. The door of claim 1, wherein the first door assembly further comprises:

a third brace mounted between the left side flange of the first panel assembly and the right side flange of the first panel assembly; and a second plurality of tabs mounted to extend from the third brace.

3. The door of claim 2, wherein the second door assembly further comprises:

a fourth brace mounted between the left side flange of the second panel assembly and the right side flange of the second panel assembly; and a second plurality of slots formed in the fourth brace;

wherein the second plurality of tabs are configured to align with and to slide down into respective ones of the second plurality of slots to mount the first door assembly to the second door assembly.

4. The door of claim 2, wherein the second panel assembly further comprises:

a first flange mounted to extend from the left side flange of the second panel assembly on a side opposite the left edge of the second panel to form a first channel;

a second flange mounted to extend from the right side flange of the second panel assembly on a side opposite the right edge of the second panel to form a second channel;

wherein the left hinge is mounted to the left side flange of the second panel assembly and the right hinge is mounted to the right side flange of the second panel assembly.

5. The door of claim 4, wherein a control panel is mounted within the first channel and the second channel.

6. The door of claim 4, wherein the first panel assembly further comprises:

a third flange mounted to extend from the left side flange of the first panel assembly on a side opposite the left edge of the first panel; and a fourth flange mounted to extend from the right side flange of the first panel assembly on a side opposite the right edge of the first panel.

7. The door of claim 6, wherein the left hinge comprises:

a left hinge plate; and a fifth flange mounted to extend from the left hinge plate parallel to the third flange;

wherein a first aperture is formed through the fifth flange and a second aperture is formed in the third flange and a fastener is inserted in the first aperture and the second aperture to mount the first door assembly to the second door assembly.

8. The door of claim 7, wherein the right hinge comprises:

a right hinge plate; and a sixth flange mounted to extend from the right hinge plate parallel to the fourth flange;

wherein a third aperture is formed through the sixth flange and a fourth aperture is formed in the fourth flange and a second fastener is inserted in the third aperture and the fourth aperture to mount the first door assembly to the second door assembly.

9. The door of claim 1, wherein the first brace is mounted directly to a first face of the first panel.

10. The door of claim 9, wherein a handle is mounted to a second face of the first panel, wherein the second face is opposite the first face.

11. The door of claim 1, wherein the first panel assembly further comprises:

a first flange mounted to extend from the left side flange of the first panel assembly on a side opposite the left edge of the first panel; and a second flange mounted to extend from the right side flange of the first panel assembly on a side opposite the right edge of the first panel;

wherein the first brace is mounted to the first flange at a first end of the first brace and to the second flange at a second end of the first brace opposite the first end of the first brace.

12. The door of claim 1, wherein the first brace is mounted to the left side flange of the first panel assembly at a first end of the first brace and to the right side flange of the first panel assembly at a second end of the first brace opposite the first end of the first brace.

13. The door of claim 1, further comprises a detergent dispenser mounted to the second panel.

14. The door of claim 1, wherein a bottom edge of the plurality of slots is sloped downwards toward the second panel.

15. The door of claim 1, wherein the second panel assembly further comprises:

a first flange mounted to extend from the left side flange of the second panel assembly on a side opposite the left edge of the second panel to form a first channel;

a second flange mounted to extend from the right side flange of the second panel assembly on a side opposite the right edge of the second panel to form a second channel;

a first channel bracket mounted within the first channel; and a second channel bracket mounted within the second channel;

wherein the left hinge is mounted to the first channel bracket and the right hinge is mounted to the second channel bracket.

16. The door of claim 15, wherein the first panel assembly further comprises:

a third flange mounted to extend from the left side flange of the first panel assembly on a side opposite the left edge of the first panel; and a fourth flange mounted to extend from the right side flange of the first panel assembly on a side opposite the right edge of the first panel.

17. The door of claim 16, wherein the left hinge comprises:

a left hinge plate; and a fifth flange mounted to extend from the left hinge plate parallel to the third flange; and further wherein the right hinge comprises a right hinge plate; and a sixth flange mounted to extend from the right hinge plate parallel to the fourth flange;

wherein a first aperture is formed through the fifth flange and a second aperture is formed in the third flange and a first fastener is inserted in the first aperture and the second aperture to mount the first door assembly to the second door assembly, wherein a third aperture is formed through the sixth flange and a fourth aperture is formed in the fourth flange and a second fastener is inserted in the third aperture and the fourth aperture to mount the first door assembly to the second door assembly.

18. The door of claim 1, wherein a protrusion is mounted to extend from the first brace and a vertical slit is formed in the second brace, wherein the protrusion is configured to align with and to slide down into the vertical slit to further mount the first door assembly to the second door assembly.

19. An appliance comprising:

a body;

a door comprising a first door assembly comprising a first panel assembly comprising a first panel;

a left side flange mounted to extend from a left edge of the first panel; and a right side flange mounted to extend from a right edge of the first panel;

a first brace mounted between the left side flange of the first panel assembly and the right side flange of the first panel assembly; and a plurality of tabs mounted to extend from the first brace; and a second door assembly mounted to the first door assembly, the second door assembly comprising a second panel assembly comprising a second panel;

a left side flange mounted to extend from a left edge of the second panel; and a right side flange mounted to extend from a right edge of the second panel;

a second brace mounted between the left side flange of the second panel assembly and the right side flange of the second panel assembly; and a plurality of slots formed in the second brace;

wherein the plurality of tabs are configured to align with and to slide down into respective ones of the plurality of slots to mount the first door assembly to the second door assembly;

a left hinge mounted to either the left side flange of the first panel or the left side flange of the second panel, the left hinge pivotally mounting the door to the body; and a right hinge mounted to either the right side flange of the first panel or the right side flange of the second panel, the right hinge pivotally mounting the door to the body.

20. The appliance of claim 19, wherein the first panel is visible from an exterior of the appliance when the door is in a closed position.

* * * * *